US006712356B2

(12) United States Patent
Daout et al.

(10) Patent No.: US 6,712,356 B2
(45) Date of Patent: Mar. 30, 2004

(54) SELF ALIGNING TRANSPORT MECHANISM FOR MEDIA OF VARIABLE MEDIA WIDTHS

(75) Inventors: Jerome Daout, Nyon (CH); Mike Nunn, West Chester, PA (US); Robert Clauser, Columbus, NJ (US)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 09/769,173

(22) Filed: Jan. 25, 2001

(65) Prior Publication Data

US 2001/0045697 A1 Nov. 29, 2001

Related U.S. Application Data

(60) Provisional application No. 60/181,307, filed on Feb. 9, 2000.

(51) Int. Cl.[7] ..... B65H 9/16

(52) U.S. Cl. ..... 271/250; 271/252

(58) Field of Search ..... 271/119, 250, 271/252, 272, 274, 276

(56) References Cited

U.S. PATENT DOCUMENTS

| | | | |
|---|---|---|---|
| 3,603,446 | A | 9/1971 | Maxey et al. |
| 4,163,157 | A | 7/1979 | Guignard et al. |
| 4,438,917 | A | 3/1984 | Janssen et al. |
| 4,833,591 | A | 5/1989 | Eckl |
| 4,855,607 | A | 8/1989 | Eckl |
| 4,918,463 | A | 4/1990 | Piatt |
| 4,971,304 | A | 11/1990 | Lofthus |
| 4,987,448 | A | 1/1991 | Chikama |
| 5,078,384 | A | 1/1992 | Moore |
| 5,090,683 | A | 2/1992 | Kamath et al. |
| 5,094,442 | A | 3/1992 | Kamprath et al. |
| 5,140,166 | A | 8/1992 | Gerlier |
| 5,582,399 | A | 12/1996 | Sugiura |
| 6,149,150 | A | 11/2000 | Onipchenko et al. |
| RE37,007 | E | 1/2001 | Gerlier |

FOREIGN PATENT DOCUMENTS

| | | |
|---|---|---|
| DE | 34 41 977 A1 | 5/1985 |
| EP | 0 206 675 | 12/1986 |
| EP | 0 848 357 A1 | 6/1998 |
| GB | 1 447 888 | 9/1976 |
| GB | 2 293 368 B | 3/1996 |
| GB | 2 317 881 A | 4/1998 |

*Primary Examiner*—David H. Bollinger
(74) *Attorney, Agent, or Firm*—Fish & Richardson P.C.

(57) ABSTRACT

Apparatus and method for aligning media. The device includes a passageway and at least one rotor. The rotor may have a surface shaped to drive a media in an intermittent fashion, or a plurality of rotors may contact the media in an intermittent fashion. Intermittent drive may also be achieved by modulating the contact pressure between a rotor and the media.

23 Claims, 6 Drawing Sheets

SIMPLIFIED PLAN VIEW (HIDDEN LINES SHOWN)

SELF ALIGNING TRANSPORT MECHANISM FOR MEDIA OF VARIABLE MEDIA WIDTHS

This application claims priority from U.S. provisional application No. 60/181,307 filed on Feb. 9, 2000.

BACKGROUND OF THE INVENTION

In banknote handling apparatus, it is desirable to accommodate media of differing widths and differing flexibility. This allows a common apparatus to be deployed in different countries with minimal modification. Further, many countries have banknotes that vary in width between denominations or different versions of a given denomination. Equipment that can handle the widest possible range of denominations (and therefore widths) offers enhanced convenience for customers and increased revenue for operators.

Some prior art systems require the user to perform some manual alignment of the media. Others require the expense and complexity of an active control system. Yet others require significant space and cost. Thus, there is a need for a simple, low-cost device capable of tolerating a wide range of customer behaviors.

SUMMARY OF THE INVENTION

Presented is a compact, simple (few moving parts) and low cost document handling device that accommodates a wide range of customer behaviors. The system could be adapted to many discrete media handling applications such as coupon, ticket, photograph, check, security document, banknote, card, token, mail, and general paper transport devices.

BRIEF DESCRIPTION OF THE DRAWINGS

Like reference numbers and designations in the various drawings indicate like elements.

For clarity the schematic drawings omit the various components used for mounting and driving the moving parts. These functions are readily accomplished by known techniques and are not the subject of this invention. In addition, the drawings may not necessarily be drawn to scale.

DESCRIPTION OF THE INVENTION

Figure 1:
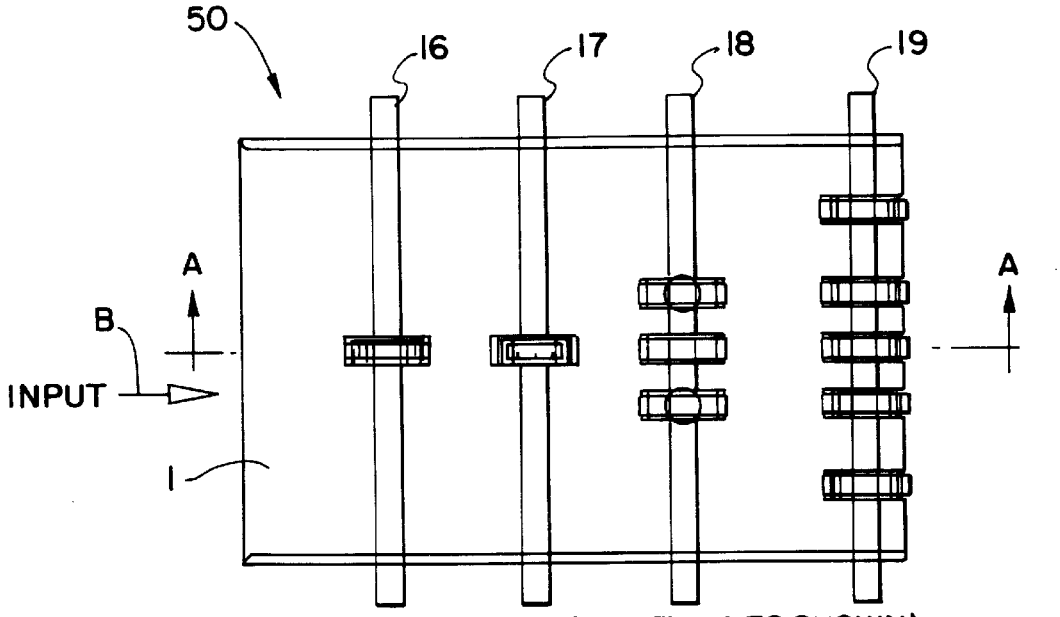
FIG. 1 shows a plan view of an implementation of an apparatus according to the invention.
Figure 2A:
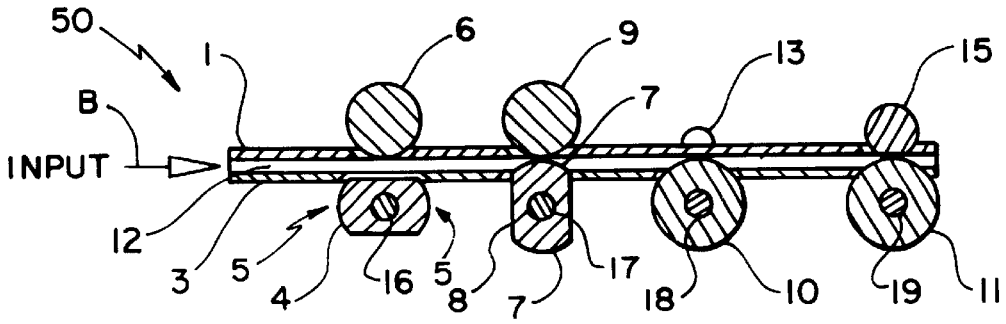
FIG. 2A shows a cross section A—A of FIG. 1 through the apparatus, and shows an example of a phase relationship between rotors (4) and (8).

Referring to FIGS. 1 and 2A, an implementation of the transport mechanism 50 includes two substantially parallel plates (1) and (3) together with side walls (not shown) that constitute a passageway (12) through which the media (2) (shown in FIGS. 3A to 4C) is drawn into the mechanism.

Two specially shaped rotors (4) and (8) are mounted respectively on rotating members (16) and (17). The rotors (4) and (8) have circular surfaces (5) and (7), respectively, which contact the media when it is inserted into the passageway (12) as the members (16) and (17) rotate. These members (16) and (17), together with additional members such as (18) and (19) are configured to rotate at such a speed that the outer surface velocity of the rotors (4) and (8) and discs (10) and (11) are approximately the same. Members (16) and (17) rotate in such a way that the phase angle between the surfaces (5) and (7) of the rotors (4) and (8) is fixed at approximately 90 degrees. Secondary idler members (6) (9) (13) and (15) are free to rotate when in contact with the media (2) that is being transported. The idler members (6) and (9) may be nip rollers.

The spherical members (13) also permit some freedom for the media (2) to slide laterally while being driven forwards (in the direction of arrow B) at the same time. In contrast, the five rollers (15) provide a relatively firm clamping action to the media. No further lateral movement or rotation occurs after this point.

Although three clamp wheels (10) are shown on shaft member (18), more or less discs (10) could be used. Similarly, more or less clamp wheels (11) could be used on shaft member (19) than the five shown in FIG. 1.

Figure 2B:
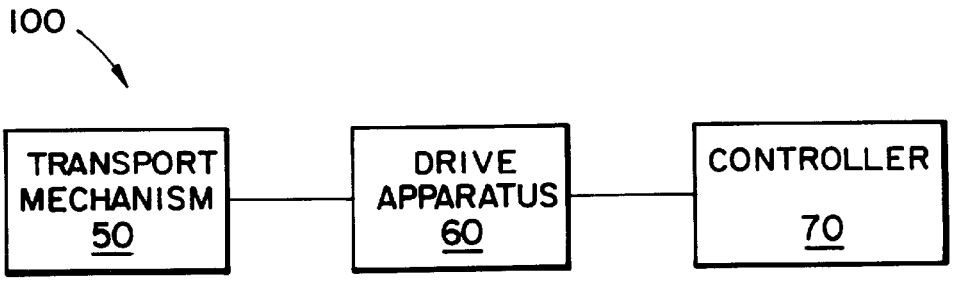
FIG. 2B shows a simplified block diagram of a transport system.

FIG. 2B is a simplified block diagram illustrating an overall transport system (100). The transport mechanism (50) is connected to a drive apparatus (60) which is connected to a controller (20). The drive apparatus may include an electric motor, such as a stepper motor, or other known drive device capable of turning the rotating members (16, 17, 18, 19) at a uniform speed, or at different speeds, and may further be capable of turning the rotating members such that they are rotating in or out of phase with each other. The drive apparatus may also be capable of functioning to provide an intermittent drive to turn one or more of the rotating members. The controller (70) may include a microprocessor or other control circuitry for controlling the operation of the drive apparatus and transport mechanism. Various gearing arrangements and/or mechanical connection means between the drive apparatus and the transport mechanism may be used to accomplish such operation, and such arrangements are outside the scope of the present invention and will not be discussed in detail herein.

Example Sequence of Operation

Figure 3A:
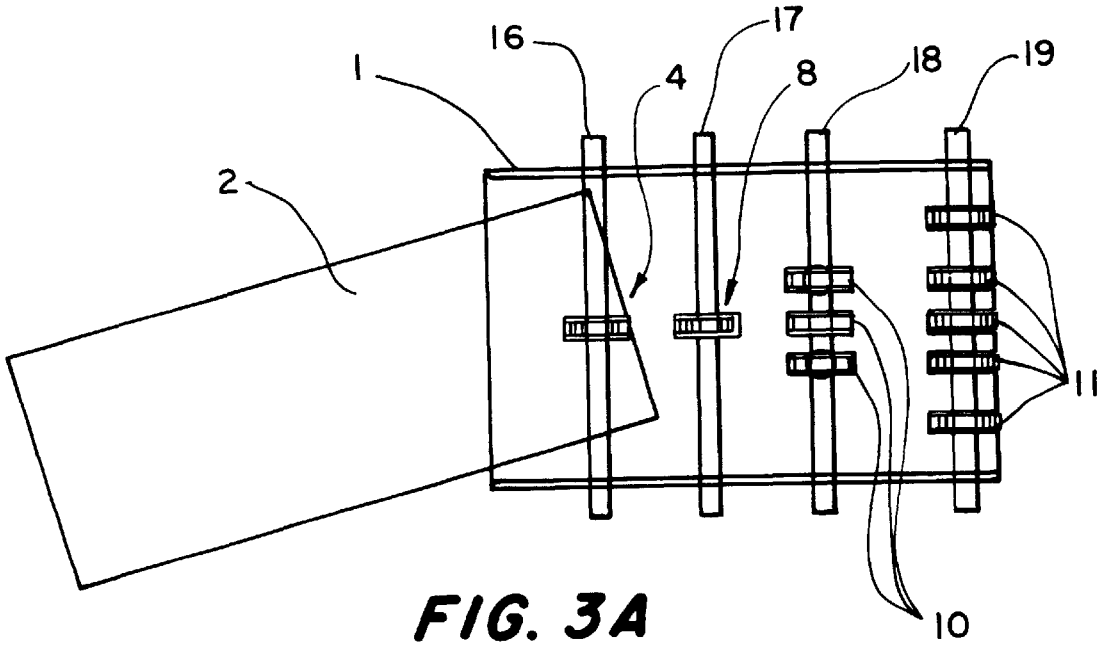
FIGS. 3A–D show a time sequence of the passage of the media through the apparatus illustrated in FIG. 1.
Figure 3B:
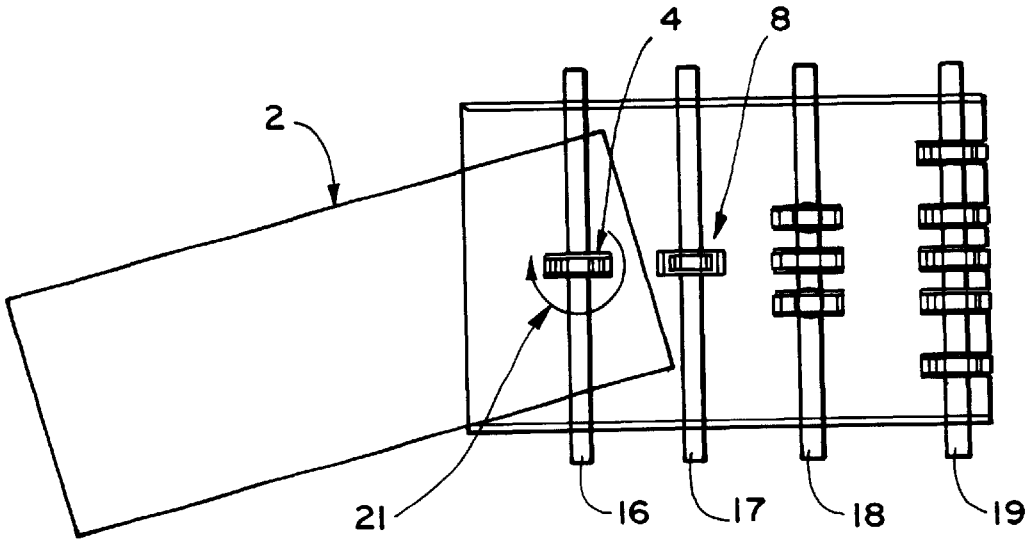
Figure 3C:
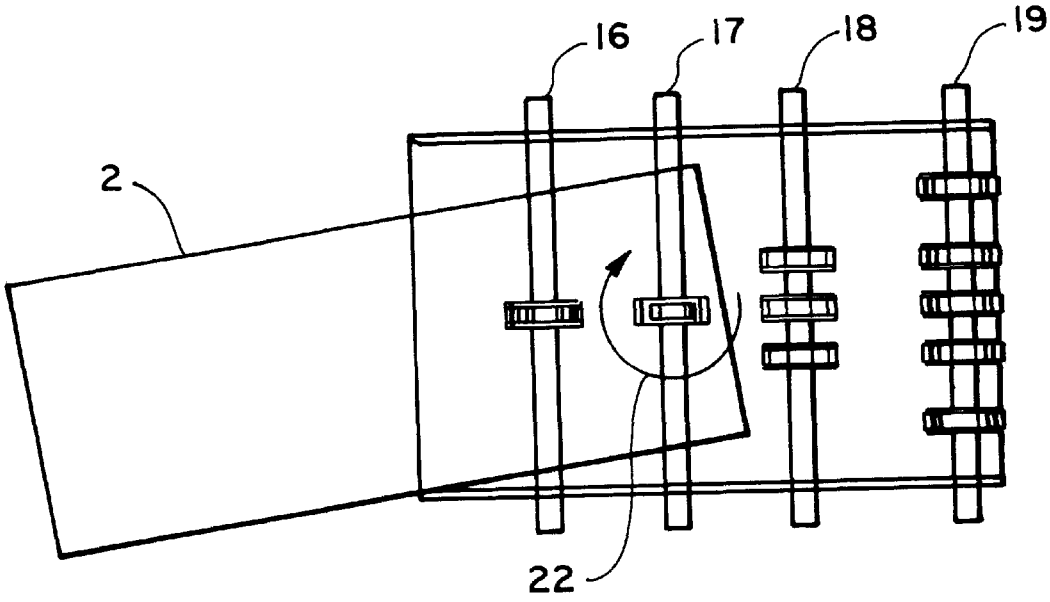
Figure 3D:
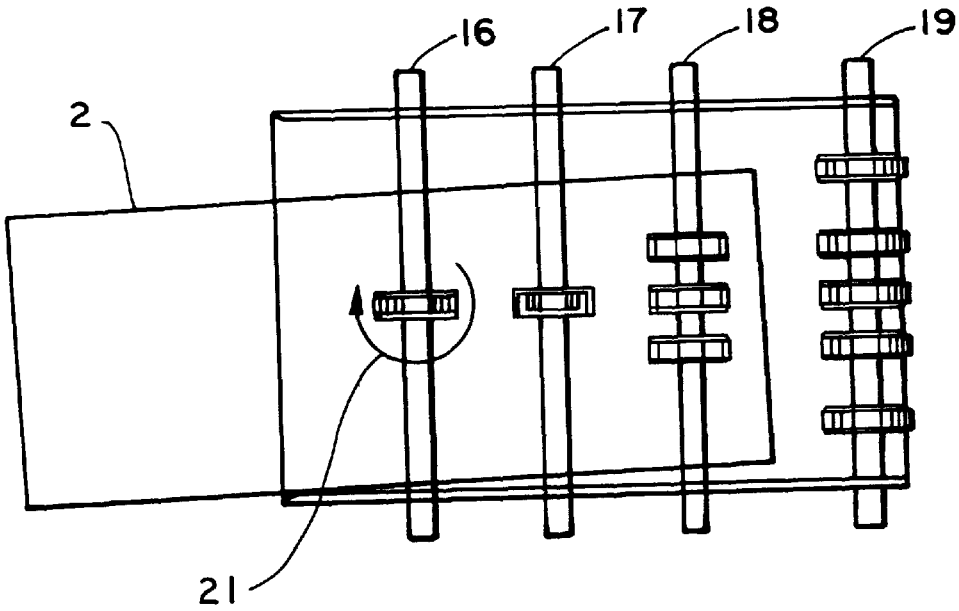

Referring to FIGS. 3A and 3D, in the case of a banknote acceptor, the customer inserts a banknote (2) into the passageway of the apparatus (1). Contact is made with the input rotor (4) and the media is drawn inwards under an intermittent drive (See FIG. 3A).

Shortly thereafter the customer will release the banknote and it moves inwards. (It should be noted that a special advantage of this invention is that intermittent tugs on the banknote by the surfaces (5) of the rotor (4) provide a strong behavioral signal to the customer that he may release the banknote. However, no harm will be done if a customer is slow to release the banknote, or even if the banknote is withdrawn entirely at this stage.) If the inserted banknote has some degree of skew and offset relative to the passageway (1) of the acceptor it may eventually strike one or other sidewall. At this point under the influence of the rotor (4) drive force and the drag against the passageway (1) the media will begin to rotate about the center of rotor (4) as shown by arrow (21) in FIG. 3B.

After a further short interval the banknote (2) arrives at the location shown in FIG. 3C. At this point rotor (4) is no longer actively engaged in driving the banknote (2). Rotor (8) has assumed this function. The media now rotates about the center of this roller as shown by arrow (22) in FIG. 3C. The combined effect of discrete rotations about two or more different centers (21), (22) permits the banknote to align itself laterally as well as angularly with the passageway (1).

Figure 4A:
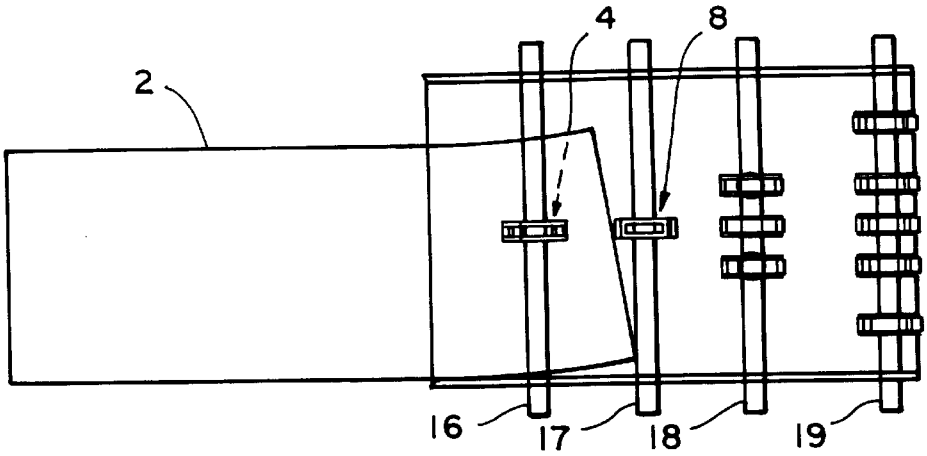
FIG. 4A shows the same plan view of the apparatus of FIG. 1 and a flexible media that is capable of elastic deformation, wherein the deformation has been exaggerated for ease of understanding.
Figure 4B:
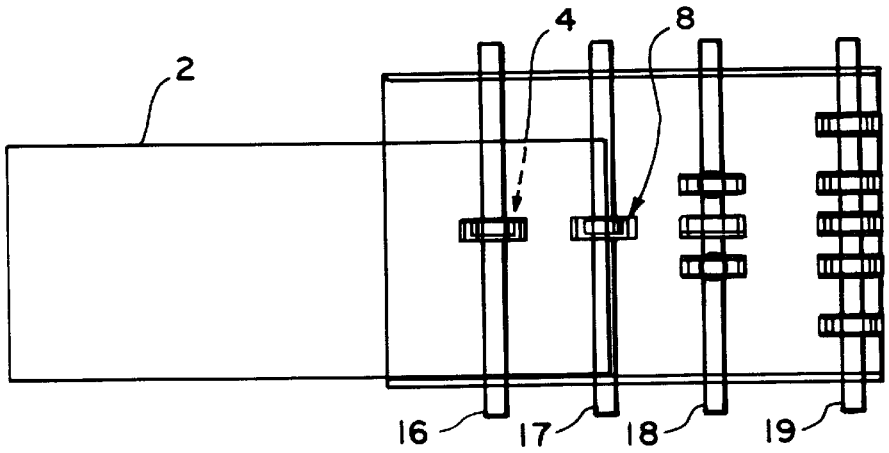
FIG. 4B shows the same plan view immediately after the first rotor disengages from the flexible media, and wherein there is a small delay before the second rotor is engaged.
Figure 4C:
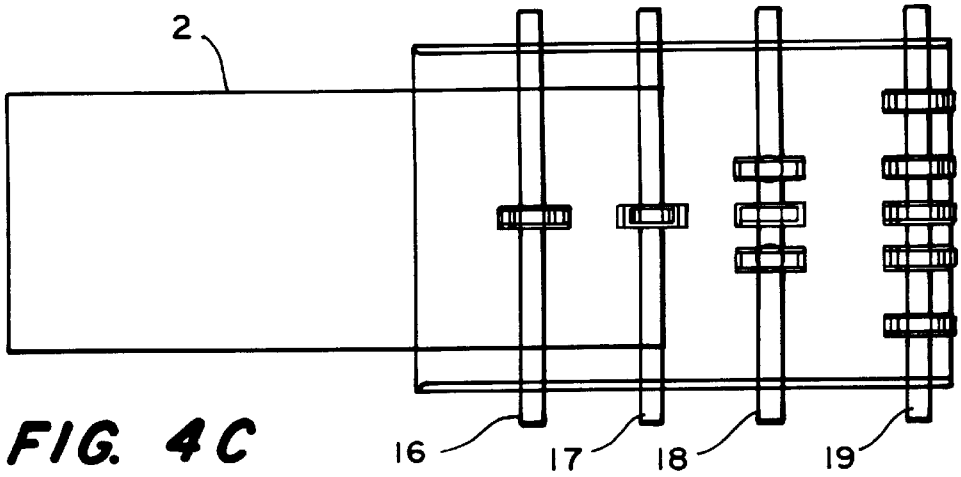
FIG. 4C shows a variation of the case shown in FIG. 4B where there is no delay before the engagement of the second rotor.

The foregoing describes the idealized motion of rigid media pivoting freely about a singular point. In practice additional effects may occur due to the flexibility of the media and small frictional forces about the intermittent centers of rotation. The effect of these properties is that the media may accumulate some distortion as it progresses past the rotors. This behavior is pictorially shown in FIG. 4A. At the point at which the rotor becomes disengaged from the media the accumulated strain energy in the distorted media is released. Depending on whether the next rotor is engaged or not at this instant the result of this release of strain energy is either that:

(1) The media performs a combination of rapid rotation and lateral slide movements towards the side of the passageway as depicted in FIG. 4B; or
(2) The media performs a rapid rotation about the next rotor towards the center of the passageway to end up as shown in FIG. 4C. (A small amount of over rotation may occur due to momentum effects)

In each case the response is a beneficial improvement in the alignment and centering of the media in the passageway.

Variations

It may be readily imagined that several other arrangements of rotors and passageway configurations may achieve similar effects. For example, one component or an arbitrary number of sub components may form the passageway. In addition, although the described document passageway is shown as straight and rectangular and of constant cross section, these attributes are not essential conditions for this invention. Many other geometries may be used.

A plurality of rotors, two or more, may be employed. Each rotor surface could be shaped and driven such that at any point in time only one rotor surface is in contact with the media (2). However, other implementations are contemplated that may utilize two or more rotor surfaces (fully or partially) to be in contact with the media surface at the same time.

A simple variation could include the case of a singular rotor (4), which provides a less positive forward motion in exchange for greater simplicity. In yet another variant, a plurality of rotors such as (4) and (8) may be mounted on a common shaft such as (16). Again, each rotor may be formed and/or phased with other rotors so that at any given moment the media (2) is in contact with the surface of approximately one rotor, or fully in contact with the surface of at least one rotor and partially in contact with the surface of at least one other rotor.

The profile of the rotors (4),(8) may take a variety of different forms and achieve similar results. The geometry illustrated with two circular arc contacts provides constant transport speed. However, other arrangements such as those having an ellipsoid surface, or having an uneven or intermittent surface, may be satisfactory in some circumstances.

If geometric constraints dictate, it may be convenient to use rotors with only one or more than two, driving segments. For example, the rotors could be of semi-circular cross section and 180 degrees out of phase or cruciform in shape with a 45-degree phase angle. Other variations are also possible.

The intermittent drive applied to the media may also be achieved by using approximately circular rotors (4),(8) and providing a means to vary their position or clamping pressure and/or contact pressure.

Depending on which attributes of the acceptor performance it is desired to optimize there may be either a small overlap between the driving portions of the rotors (good for smooth transport speed), or a small gap between the driving sectors (good for maximum self aligning and possibly jam avoidance).

If the connected equipment has a preferred media positioning requirement, such as centered or left aligned, the foregoing apparatus may be combined with some known methods that align the media as required. In this instance the above invention creates assured continuity of drive while allowing freedom for the media (2) to be aligned by another mechanism.

Figure 5A:
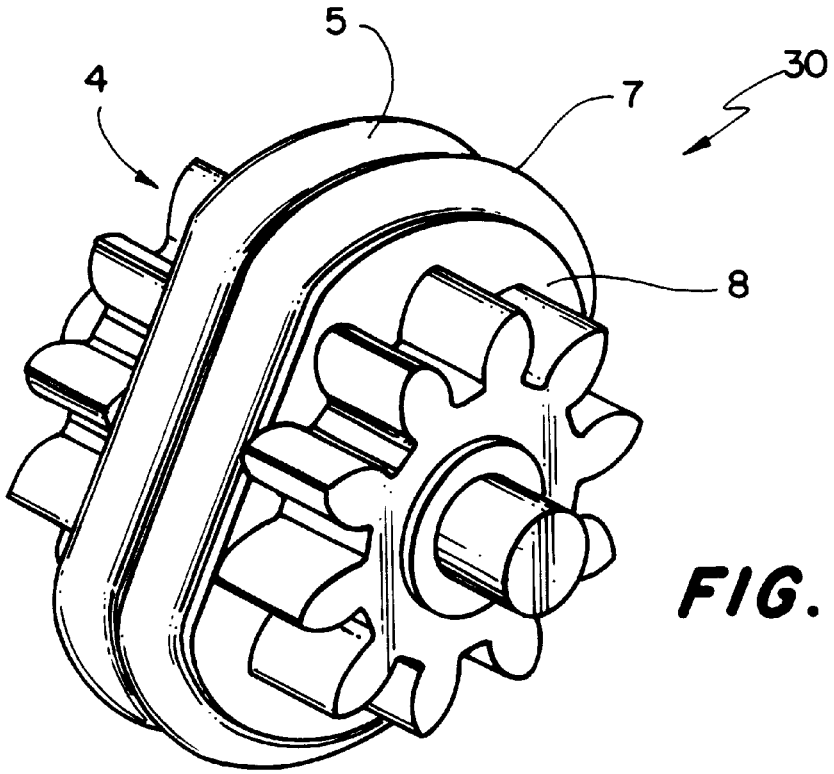
FIGS. 5A and 5B show another implementation where the driving rotors change configuration to a circular profile when the media is under drive in the reverse direction.
Figure 5B:
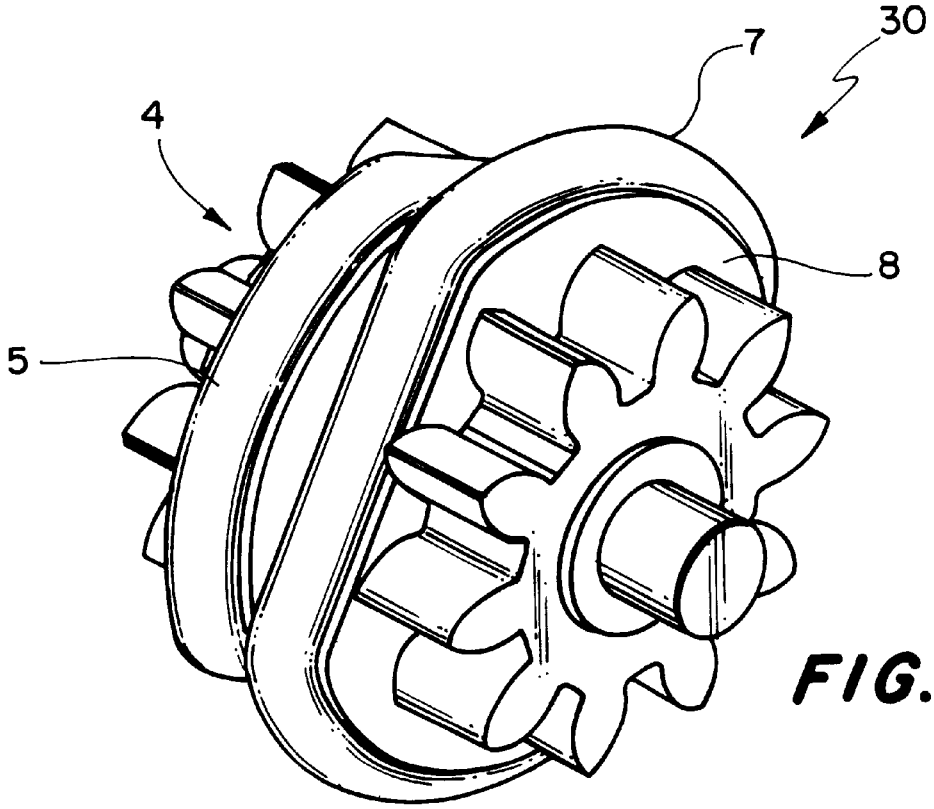

FIGS. 5A and 5B show an alternate implementation 30 of the basic mechanism that is of use if bi-directional transport of the media (2) is required. Such operation may be required, for example, if it is occasionally necessary to reject a damaged or counterfeit banknote from a banknote acceptor via the same passageway that is used for insertion.

In this implementation 30, the rotors (4),(8) are split into two parallel rotors of similar profile. A drive arrangement (not shown) causes the two halves of the rotors to be aligned as shown in FIG. 5A during banknote insertion where they effectively act as one part to transport media in the direction of arrow B of FIGS. 1 and 2. Thus, both surfaces (5) and (7) are used to drive the media. When reverse rotation is required, however, half of the rotor rotates 90 degrees with respect to its neighbor as shown in FIG. 5B. The effect is to simulate a one-piece circular rotor having a continuous surface formed by the surfaces (5) and (7) for contact with the media. Such a rotor in tandem with its peers provides a direct transport along the passageway (12) in a reverse direction (opposite arrow B of FIGS. 1 and 2). The media (2) is restrained from rotation in this circumstance and possibly causing a jam. Many possible variants of rotor geometry (as described above) may be combined with this implementation to achieve the same end effect.

Figure 5C:
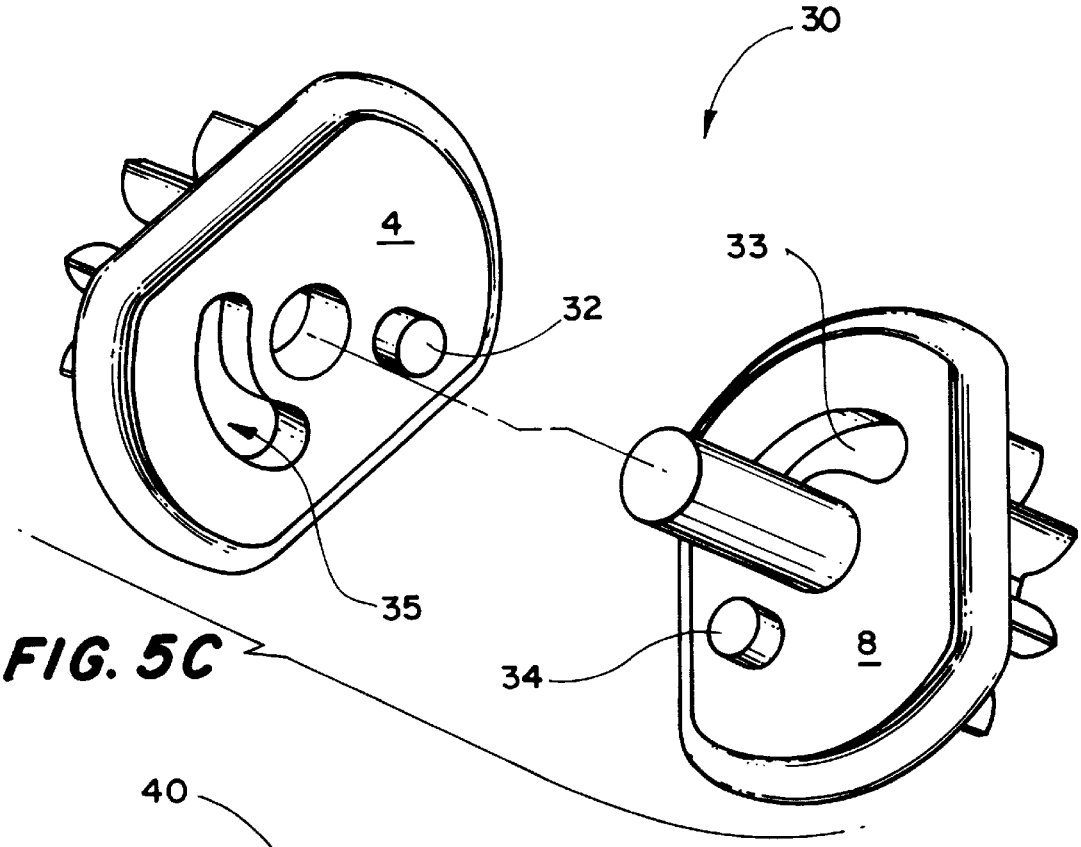
FIG. 5C is an exploded view of the rotor assembly shown in FIGS. 5A and 5B.

FIG. 5C is an exploded view of the combination rotor (30) of FIGS. 5A and 5B. In this implementation, the rotor (4) includes a guide (32) that moves in a circular slot (33) when the combination rotor is to drive media in an opposite direction. Similarly, the rotor (8) includes a guide (34) for movement in circular slot (35) when the combination rotor (30) changes configurations as shown in FIGS. 5A and 5B.

Figure 6:
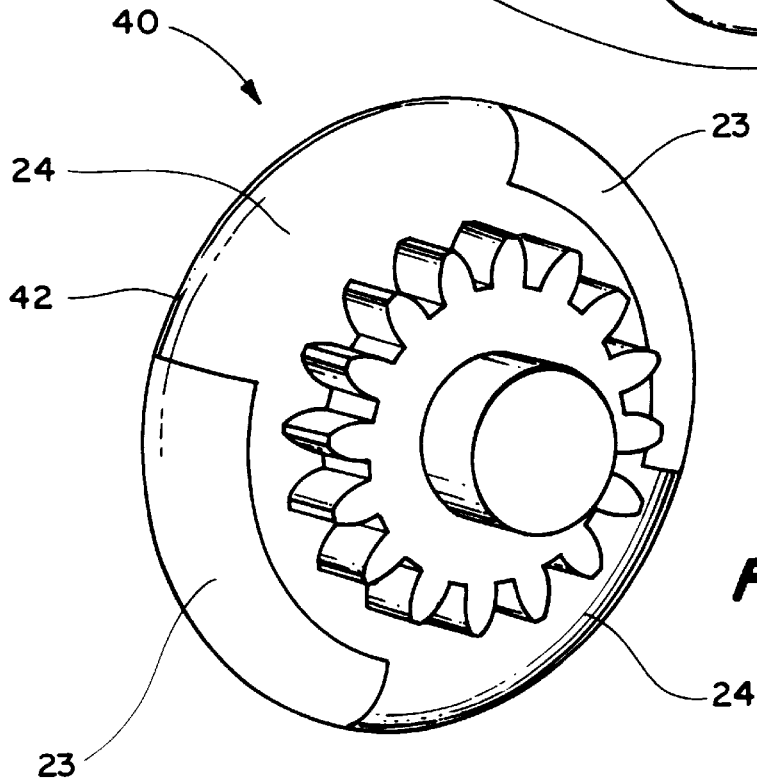
FIG. 6 is an enlarged perspective view of another implementation of a rotor that includes a continuous substantially circular surface having regions of high friction and low friction.

FIG. 6 illustrates another implementation of a rotor (40) that could be used in the system shown in FIG. 1. The rotor (40) is substantially circular in shape, and has a continuous outer surface (42) that is divided into discrete high friction regions (23) and low friction regions (24). The drive force of the rotor (40) is thereby modulated during use by a change in the frictional properties at the point of engagement of the contact surfaces with the media. The arrangement and number of sectors (23) and (24) may be varied to achieve enhanced or reduced intermittent drive effects. For example, a plurality of high friction regions may be arranged in a number of narrow or broad strips about the outer surface (42). Further, the drive force of the rotor (40) may be modulated by a combination of methods described above, such as by varying the contact pressure that the surfaces (23) and (24) place on the media in a periodic manner.

A number of embodiments of the present invention have been described. Nevertheless, it should be understood that various modifications might be made without departing from the spirit and scope of the invention. For example, the rotor implementation 30 of FIGS. 5A to 5C could include one or more high and low friction surface regions as described with regard to the implementation 40 of FIG. 6. Accordingly other embodiments are within the scope of the following claims.

What we claim is:

1. An apparatus comprising:

a passageway; and a plurality of rotors aligned substantially parallal to side walls of the passageway, at least one rotor having a surface shaped to drive a media in an intermittent fashion in a direction longitudinal to the passageway so as to align the media substantially with the side walls wherein the media is free to rotate about each rotor.

2. The apparatus of claim 1 wherein the intermittent drive is achieved by intermittent contact of the surface with the media.

3. The apparatus of claim 1 wherein the surface of at least one rotor is generally circular and wherein intermittent drive is achieved by operating the rotor in an intermittent fashion.

4. The apparatus of claim 1 further comprising:

a drive apparatus for maintaining the rotors in a phase angle relationship.

5. The apparatus of claim 4 wherein the rotors and have alternate geometric forms.

6. The apparatus of claim 5, wherein the geometric forms comprise at least one of a semicircle, an ellipsoid, a trilobular, a multifacial polygon, and a cruciform.

7. The apparatus of claim 4 where the contact surfaces of rotors are of circular form and the intermittent drive is obtained by moving the rotors in an intermittent manner.

8. The apparatus of claim 4 wherein the rotors are substantially circular and have an outer surface with at least one high friction surface and at least one low friction surface.

9. The apparatus of claim 1 wherein the rotor surface is of generally circular form and is in contact with the media such that the intermittent drive is obtained by modulating the contact pressure between the rotor surface and the media.

10. The apparatus of claim 9 further comprising a drive apparatus for maintaining the rotors in a phase relationship such that substantially one rotor drives the document at any one time.

11. The apparatus of claim 10 wherein the rotors have different geometric forms.

12. The apparatus of claim 11 wherein the geometric forms comprise at least one of a semicircle, an ellipsoid, a trilobular, a multi-facial polygon and a cruciform.

13. The apparatus of claim 9 wherein the rotor has a variable geometry capable of presenting a continuous drive surface or an intermittent drive surface.

14. The apparatus of claim 13 wherein the intermittent drive surface is used to transport the media into the apparatus, and the continuous drive surface is used to drive the media out of the apparatus.

15. The apparatus of claim 1 wherein the at least one rotor includes a continuous and substantially circular contact surface including at least one high friction region and at least one low friction region.

16. The apparatus of claim 15 wherein an enhanced intermittent drive may be obtained by modulating the normal contact pressure of the rotor contact surface with the media.

17. The apparatus of claim 15 wherein a rotor has a variable geometry capable of presenting a continuous drive surface or an intermittent drive surface.

18. The apparatus of claim 12 wherein the intermittent drive surface is used to transport the media into the apparatus, and the continuous drive surface is used to drive the media out of the apparatus.

19. The apparatus of claim 1 wherein at least one rotor has a variable geometry capable of presenting a continuous drive surface or an intermittent drive surface.

20. The apparatus of claim 19 wherein the intermittent drive surface is used to transport the media into the apparatus, and the continuous drive surface is used to drive the media out of the apparatus.

21. A method of producing a lateral shift in the location of discrete media comprising:

driving a media into a media passageway; and shifting the media via a combination of rotations about a plurality of intermittent centers while the media is being driven in a direction substantially longitudinal to the passageway.

22. A method for continuously driving media comprising:

driving the media into a passageway having a plurality of rotors; and transporting the media in a direction substantially longitudinal to the passageway with drive rotors having surfaces arranged to have intermittent degrees of contact with the media so as to align the media substantially parallel with side walls of the passageway.

23. A method of transporting flexible media in a media transport system comprising:

driving the flexible media into a passageway using an intermittent drive system; and releasing the media to permit stored strain energy of the flexible media to be released such that the media aligns itself during transport in a direction substantially longitudinal to the passageway by sliding against a passageway wall.

* * * * *

UNITED STATES PATENT AND TRADEMARK OFFICE

CERTIFICATE OF CORRECTION

PATENT NO. : 6,712,356 B2 
DATED : March 30, 2004
INVENTOR(S) : Jerome Daout, Mike Nunn and Robert Clauser It is certified that error appears in the above-identified patent and that said Letters Patent is hereby corrected as shown below:

Column 5,
Line 20, replace “parallal” with -- parallel --

Column 6,
Line 21, replace “12” with -- 17 --

Signed and Sealed this

Tenth Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,712,356 B2 
DATED : March 30, 2004
INVENTOR(S) : Jerome Daout, Mike Nunn and Robert Clauser It is certified that error appears in the above-identified patent and that said Letters Patent is hereby corrected as shown below:

Title page,
Item [56], References Cited, U.S. PATENT DOCUMENTS, add the following:

| | | |
|---|---|---|
| -- 3,506,258 | 04/1970 | Lindquist |
| 4,143,755 | 03/1979 | Keller |
| 4,443,006 | 04/1984 | Hasegawa |
| 5,188,350 | 02/1993 | Hayashi |
| 5,261,657 | 11/1993 | Edin |
| 5,577,719 | 11/1996 | Nicoll -- |

Signed and Sealed this

Twenty-third Day of November, 2004

JON W. DUDAS
*Director of the United States Patent and Trademark Office*

UNITED STATES PATENT AND TRADEMARK OFFICE

CERTIFICATE OF CORRECTION

PATENT NO. : 6,712,356 B2 
DATED : March 30, 2004
INVENTOR(S) : Jerome Daout, Mike Nunn and Robert Clauser It is certified that error appears in the above-identified patent and that said Letters Patent is hereby corrected as shown below:

Title page,
Item [56], References Cited, U.S. PATENT DOCUMENTS, add the following:

| | | |
|---|---|---|
| -- 3,506,258 | 04/1970 | Lindquist |
| 4,143,755 | 03/1979 | Keller |
| 4,443,006 | 04/1984 | Hasegawa |
| 5,188,350 | 02/1993 | Hayashi |
| 5,261,657 | 11/1993 | Edin |
| 5,577,719 | 11/1996 | Nicoll --. |

Signed and Sealed this

Twenty-seventh Day of September, 2005

JON W. DUDAS
*Director of the United States Patent and Trademark Office*